United States Patent [19]

Marcade

[11] 4,329,596

[45] May 11, 1982

[54] DISHWASHER DISPENSER CONTROL

[75] Inventor: Roque D. Marcade, Lincoln Township, Berrien County, Mich.

[73] Assignee: Whirlpool Corporation, Benton Harbor, Mich.

[21] Appl. No.: 226,814

[22] Filed: Jan. 21, 1981

[51] Int. Cl.[3] ..... B08B 3/00

[52] U.S. Cl. ..... 307/141.8; 134/58 D

[58] Field of Search ..... 307/139, 141.4, 141.8; 134/56 D, 57 D, 58 D

[56] References Cited

U.S. PATENT DOCUMENTS

| | | | |
|---|---|---|---|
| 2,181,983 | 12/1939 | Voris | 141/9 |
| 2,914,073 | 11/1959 | Ullman, Jr. | 134/58 |
| 3,177,380 | 4/1965 | Jacobs | 307/141.8 |
| 4,134,003 | 1/1979 | Hahn | 219/327 |
| 4,213,313 | 7/1980 | Kiefer et al. | 68/12 R |

*Primary Examiner*—Michael L. Gellner

*Attorney, Agent, or Firm*—Wegner, Stellman, McCord, Wood & Dalton

[57] ABSTRACT

A dishwasher dispenser control having a circuit including two single pole, double throw switches for actuating the heater of the dishwasher independently or in combination with dispenser elements of the dishwasher. The operators for the dispenser elements, in the illustrated embodiment, are low resistance, bimetal heater elements and are arranged to be connected in series with the dishwasher heater to effect operation of the dispensers. In one arrangement, a single one of the dispenser operator elements is connected in series with the dishwasher heater, and in another arrangement, each of the dispenser elements is connected in series with the heater element.

14 Claims, 4 Drawing Figures

FIG. 1
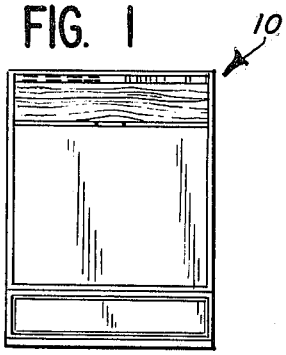
FIG. 2
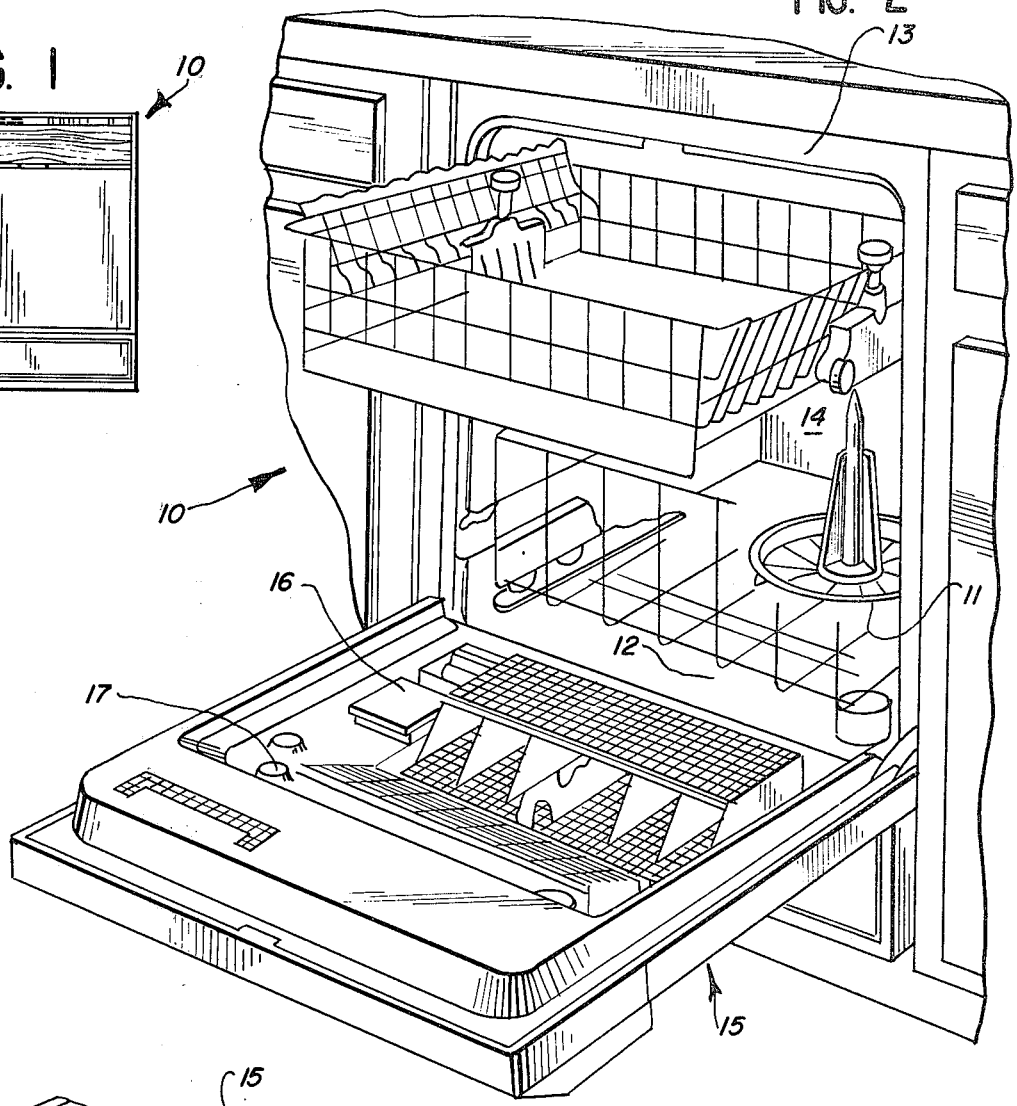
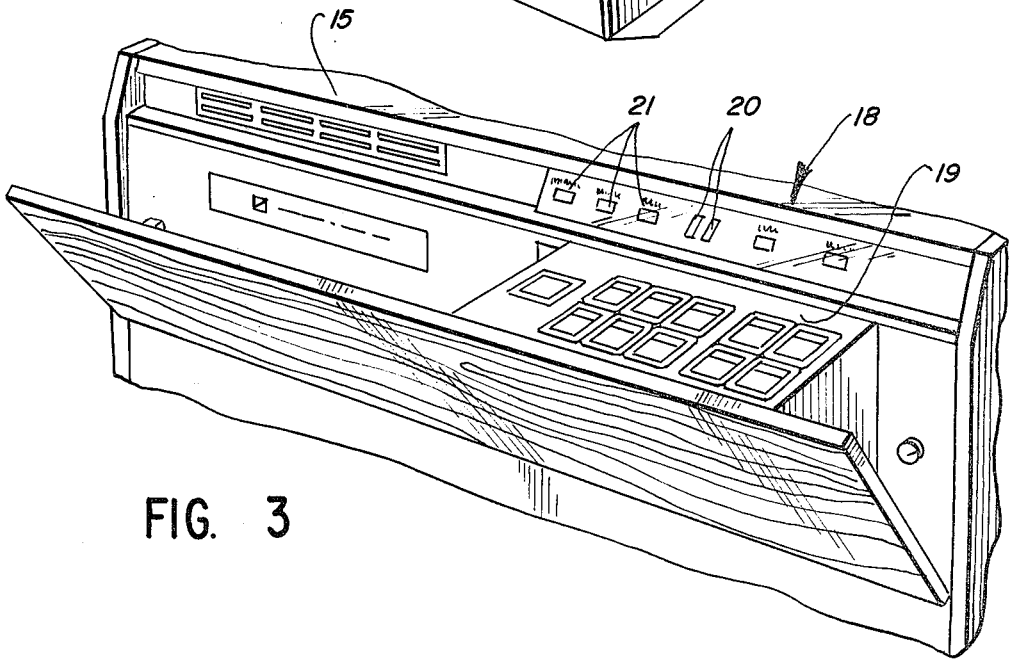
FIG. 3

DISHWASHER DISPENSER CONTROL

BACKGROUND OF THE INVENTION

1. Field of the Invention

This invention relates to dishwasher apparatus, and in particular to means for controlling the dispensing of dishwashing liquid additives selectively in the operation of the dishwasher apparatus.

2. Description of the Background Art

In U.S. Pat. No. 4,134,003 of Ronald E. Hahn, which patent is owned by the assignee hereof, a dishwasher control is shown wherein the heater of the dishwasher is connected selectively directly across the power supply or in series with a detergent dispenser operator heater element. The control utilizes a timer having six timed switches, each comprising a single pole switch. One of the timer switches is connected between the power supply lead and the heater and another of the timer switches is connected between the power supply lead and the detergent dispenser heater element.

Mabel A. Voris shows, in U.S. Pat. No. 2,181,983, an automatic dishwashing machine having a plurality of controls for causing the dishwasher to provide an automatic dishwashing cycle.

In U.S. Pat. No. 2,914,073, Myron E. Ullman, Jr. shows a dishwasher construction utilizing a plurality of single pole, double throw switches in the control thereof. The circuitry is complex and is arranged to connect the controlled elements in a specific arrangement disclosed.

In U.S. Pat. No. 3,177,380, James W. Jacobs shows an impulse timer for use in a dishwasher in a circuit utilizing a single pole, double throw switch and a single pole, single throw switch to actuate two different dispensers and a heater circuit.

George E. Keifer et al show, in U.S. Pat. No. 4,213,313, a dishwasher control circuit employing four relays to provide eight operating functions. The control selects transitional relay combinations between operative combinations to prevent inadvertent initiation of a function which might otherwise occur as a result of a race condition in switching the relays.

SUMMARY OF THE INVENTION

The present invention comprehends an improved, simplified low cost dishwasher apparatus control for use in controlling two dispenser operator elements and the electrical heater of the dishwasher.

The control utilizes two single pole, double throw switch elements controlling the selective energization of the three components in a novel and a simple circuit.

More specifically, the invention comprehends the provision in a dishwasher apparatus having an electric heater, an electric detergent dispenser operator, and an electric wetting agent dispenser operator electrically serially connected, and control means for cyclically operating the dishwasher through washing, rinsing and drying operations, of circuit means operated by the control means for electrically connecting the heater, the wetting agent dispenser operator, and the detergent dispenser operator selectively between opposite first and second power supply connections, including, means for connecting the heater to the first power supply connection, first switch means for connecting the second power supply connection selectively to (a) the detergent dispenser operator and (b) an electrical connection means, second switch means for connecting the heater selectively to (c) between the series connected operators and (d) to the electrical connection, and means for selectively arranging the first and second switch means (e) to connect the heater and the second power supply connection to the electrical connection means to connect the heater directly between the first and second power supply connections for energization of the heater, (f) to connect the detergent dispenser operator directly between the second power supply connection and the heater to energize the detergent dispenser operator and heater concurrently, and (g) to connect the detergent dispenser operator and wetting agent dispenser in series between the second power supply connection and the heater to engage the operators and heater concurrently.

Further more specifically, the invention comprehends the provision in a dishwasher control means for advancing a dishwasher through a program of washing, rinsing and drying operations, the control means having a source of power, circuit means for operating a heater, a detergent dispenser and a wetting agent dispenser of the dishwasher, the circuit means including a resistance heater element connected to a first potential of a power source, a first bimetal resistance means for operating the wetting agent dispenser, the first bimetal means being electrically connected in series with the heater means, a second bimetal resistance means for operating the detergent dispenser, the second bimetal means being electrically connected in series with the heater means and the first bimetal means, a first single pole, double throw relay connected to a second potential of said power source, the first relay having a pole movable from a first position electrically connecting an electrical conductor to the second potential to a second position connecting one of the bimetal means to the second potential, a second single pole, double throw relay electrically connected to the heater and the other of the bimetal means, the second relay having a pole movable from a first position electrically connecting the one bimetal means to the heater to a second position electrically connecting the conductor to said heater, and means for providing a signal for moving the poles selectively from the first positions to the second positions.

Thus, the dishwasher control circuit of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a front elevation of a dishwasher having an improved control circuitry embodying the invention;

FIG. 2 is a fragmentary perspective view of the dishwasher showing the detergent and wetting agent dispensers in the front door thereof;

FIG. 3 is a fragmentary perspective view of the control of the dishwasher.

DESCRIPTION OF THE PREFERRED EMBODIMENT

Figure 4:
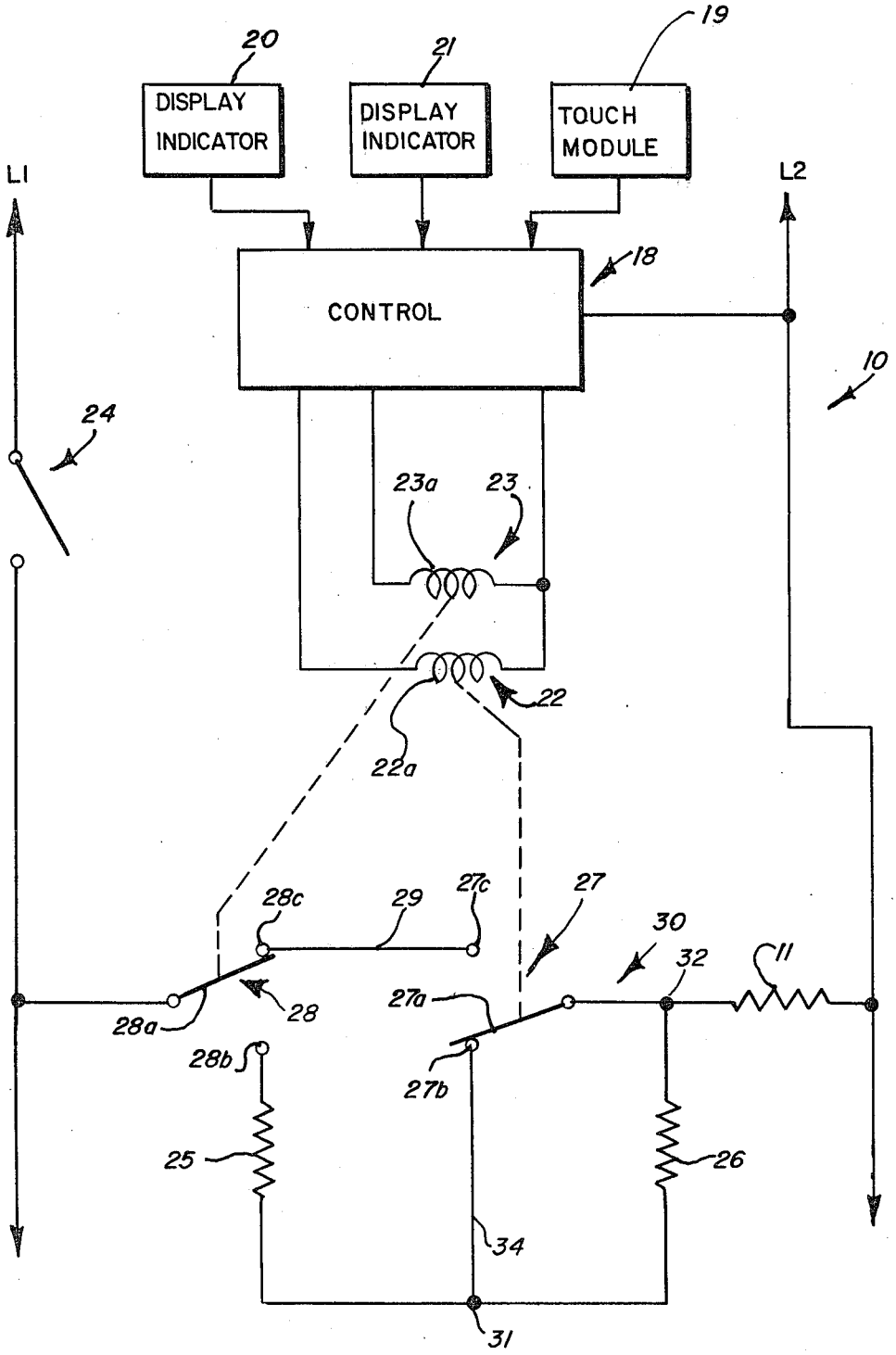
FIG. 4 is a schematic wiring diagram showing the improved circuit of the invention.

In the exemplary embodiment of the invention as disclosed in FIGS. 1 and 2 of the drawings, a dishwasher generally designated 10 is provided with a heater 11 in a bottom portion 12 of the housing 13 thereof defining a washing chamber 14. The washing chamber is selectively closed by a front door 15.

In the illustrated embodiment, the detergent dispenser 16 and a wetting agent dispenser 17 are mounted on the door 15 so as to be exposed to the washing chamber when the door is in the closed disposition.

A control 18 for operating the dishwasher through washing, rinsing and drying operations is mounted in an upper portion of the door 15. As shown in FIG. 3, the control 18 includes a touch input module 19 for manually selecting different cycles of operation of the dishwasher. The control further includes a display, which, in the illustrated embodiment, comprises a digital display 20, and an indicator, which, in the illustrated embodiment, comprises a plurality of indicator lights 21.

Referring more specifically to the electrical control circuitry illustrated in FIG. 4, an improved circuit 30 of the invention includes a first relay 22 having a coil 22*a* and a second relay 23 having a coil 23*a*. Coils 22*a* and 23*a* are connected to control 18 for selective energization by the control in carrying out the normal dishwashing cycles.

Power is provided to the control circuit from a first power supply lead L1 having a normally open door switch 24 in series therewith for providing electrical power to the control circuit only when the dishwasher door is in the closed position, and a second power supply lead L2. The electric heater 11 is connected from power supply lead L2 to power supply lead L1 through switches 27 and 28 of relays 22 and 23, respectively.

As shown in FIG. 4, switch 27 comprises a single pole, double throw switch having a moving contact 27*a*, a first fixed contact 27*b* and a second fixed contact 27*c*. Switch 28 comprises a single pole, double throw switch having a moving contact 28*a*, a first fixed contact 28*b*, and a second fixed contact 28*c*. Second fixed contacts 27*c* and 28*c* are connected by an electrical conductor or connection means 29. First fixed contact 27*b* of switch 27 is electrically connected by an electrical conductor 34 to a junction 31. Detergent dispenser operator 25, comprising a bimetal heater element, is connected from fixed contact 28*b* of switch 28 to junction 31, and wetting agent dispenser operator 26, comprising a bimetallic heater element, is connected between junction 31 and a junction 32 between moving contact 27*a* of switch 27 and heater 11.

The operation of control 18 and control circuit 30 is extremely simple. The desired cycles of operation of the dishwasher may be varied by the user of the apparatus as selected by suitable fingertip engagement with the touch input module 19 after the control is tilted outwardly to the position shown in FIG. 3. The selection entered in control 18 programs the operation of the dishwasher through the dishwashing cycles.

The bimetal heater operators 25 and 26 have low electrical resistance. In the arrangement of circuit 30, the operators, when energized, are connected in series with heater 11 which, therefore, limits the current flow through the operator heaters to a safe value while, at the same time, the series arrangement assures that the heater 11 will be energized concurrently with the energization of the operators.

In the arrangement of the switches 27 and 28 illustrated in full lines in FIG. 4, the circuit to heater 11 is open. Upon operation of control 18 to effect initiation of a heated dishwashing cycle, relay coil 22*a* is energized by control 18 to throw movable contact 27*a* from engagement with fixed contact 27*b* into engagement with fixed contact 27*c*. With switch 28 maintained in the normal position of FIG. 4, the throwing of switch 27 to fixed contact 27*c* connects heater 11 directly between power supply lead L1 and L2 to effect energization thereof such as in the first wash and original rinse cycles.

During a second wash cycle, it is desirable to operate the detergent dispenser to introduce further detergent into the wash water at that time. To effect this, control 18 causes energization of relay coil 23*a* at the proper time in the second wash cycle to throw moving contact 28*a* of switch 28 from fixed contact 28*c* into engagement with fixed contact 28*b* at the same time coil 22*a* may be deenergized allowing movable contact 27*a* to return to the full line position of FIG. 4 in contact with fixed contact 27*b*. Thus, a circuit is established from power supply lead L1 through switch 28, detergent dispenser operator 25, and switch 27 to heater 11. While operator 25 is connected in series with heater 11, as it has substantially lower resistance, the energization of heater 11 is continued. At the same time, energization of operator 25 causes operation of detergent dispenser 16 to deliver into the wash water during the second wash cycle the desired detergent. It should be noted that during this operation, switch 27 effectively shorts out the wetting agent dispenser operator 26, preventing operation thereof at this time.

To effect desired delivery of wetting agent from dispenser 17 in a subsequent rinse operation, switch 27 is thrown by suitable energization of relay coil 22*a* by control 18 to break the shorting connection from fixed contact 27*b* across operator 26, while maintaining the electrical connection from power supply lead L1 to the operator 25 through switch 28. Thus, each of the operators 25 and 26 is placed in series with heater 11 so as to effect energization of operator 26, thereby to operate the wetting agent dispenser 17 while maintaining energization of heater 11 as a result of the low resistance of the series connected operators 25 and 26.

Control 18 is extremely simple in that it need provide only two different control functions relative to coils 22*a* and 23*a*. Either the coils are energized or they are deenergized, and the circuit 30 is arranged to use such selective energization of the coils to provide three different arrangements of the operators and heater, as well as "off" condition illustrated in FIG. 4.

Thus, control circuit 30 provides an improved, simplified circuitry utilizing effectively minimum circuit components, while yet providing four separate circuit conditions and operation of three dishwasher components in a novel and simple manner.

The foregoing disclosure of specific embodiments is illustrative of the broad inventive concepts comprehended by the invention.

I claim:

1. In a dishwasher apparatus having an electric heater, an electric detergent dispenser operator, an electric wetting agent dispenser operator, said heater and said operators electrically serially connected, and control means for cyclically operating the dishwasher through washing, rinsing and drying operations, improved circuit means operated by said control means for electrically connecting said heater, said wetting agent dispenser operator, and said detergent dispenser operator selectively between opposite first and second power supply connections, said circuit means comprising:

means for connecting said heater to said first power supply connection;

first switch means for connecting said second power supply connection selectively to (a) said detergent dispenser operator and (b) an electrical connection means;

second switch means for connecting said heater selectively to (c) between said series connected operators and (d) to said electrical connection; and means for selectively arranging said first and second switch means (e) to connect said heater and said second power supply connection to said electrical connection means to connect said heater directly between said first and second power supply connections for energization of the heater, (f) to connect said detergent dispenser operator directly between said second power supply connection and said heater to energize said detergent dispenser operator and heater concurrently, and (g) to connect said detergent dispenser operator and wetting agent dispenser in series between said second power supply connection and said heater to energize said operators and heater concurrently.

2. The dishwasher apparatus of claim 1 wherein said operators comprise low impedance means whereby said heater is substantially fully energized when connected in series with said operators.

3. The dishwasher apparatus of claim 1 wherein said operators comprise low resistance means whereby said heater is substantially fully energized when connected in series with said operators.

4. The dishwasher apparatus of claim 1 wherein said operators comprise low resistance bimetal means whereby said heater is substantially fully energized when connected in series with said operators.

5. The dishwasher apparatus of claim 1 wherein said first and second switch means comprise relays having coils actuated by said control means.

6. The dishwasher apparatus of claim 1 wherein each of said switch means comprises a single pole, double throw switch.

7. The dishwasher apparatus of claim 1 wherein said first switch means comprises a single pole, double throw switch having its moving contact connected to said second power supply connection.

8. The dishwasher apparatus of claim 1 wherein said first switch means comprises a single pole, double throw switch having its moving contact connected to said second power supply connection, a first fixed contact connected to said detergent dispenser operator, and a second fixed contact connected to said electrical connection means.

9. The dishwasher apparatus of claim 1 wherein said second switch comprises a single pole, double throw switch having its moving contact connected to said heater.

10. The dishwasher apparatus of claim 1 wherein said second switch comprises a single pole, double throw switch having its moving contact connected to said heater, a first fixed contact connected to between said operators, and a second fixed contact connected to said electrical connection means.

11. In a dishwasher control means for advancing a dishwasher through a program of washing, rinsing and drying operations, said control means having a source of power, circuit means for operating a heater, a detergent dispenser and a wetting agent dispenser of said dishwasher, said circuit means comprising:

a resistance heater element connected to a first potential of a power source;

a first bimetal resistance means for operating said wetting agent dispenser, said first bimetal means being electrically connected in series with said heater means;

a second bimetal resistance means for operating said detergent dispenser, said second bimetal means being electrically connected in series with said heater means and said first bimetal means;

a first single pole double throw relay connected to a second potential of said power source, said first relay having a pole movable from a first position electrically connecting an electrical conductor to said second potential to a second position connecting one of said bimetal means to said second potential;

a second single pole double throw relay electrically connected to said heater and the other of said bimetal means, said second relay having a pole movable from a first position electrically connecting said one bimetal means to said heater to a second position electrically connecting said conductor to said heater; and means for providing a signal for independenly moving said poles selectively from said first positions to said second positions.

12. The dishwasher control means of claim 11 wherein said resistance means have a low resistance such that said heater is substantially fully energized when said resistance means are either individually or serially connected in series with said heater, said heater being energized directly between said potentials when said first relay pole is in said first position and said second relay pole is in said second position.

13. The dishwasher control means of claim 11 wherein said resistance means have a low resistance such that said heater is substantially fully energized when said resistance means are either individually or serially connected in series with said heater, said heater being energized directly between said potentials when said first relay pole is in said first position and said second relay pole is in said second position, and in series with said second resistance means alone when said first relay pole is in said second position and said second relay pole is in said first position.

14. The dishwasher control means of claim 11 wherein said resistance means have a low resistance such that said heater is substantially fully energized when said resistance means are either individually and serially connected in series with said heater, said heater being energized directly between said potentials when said first relay pole is in said first position and said second relay pole is in said second position, and in series with each of said resistance means when said first relay pole is in said second position and said second relay pole is in said second position.

* * * * *